United States Patent [19]

Kuehmichel

[11] Patent Number: 5,033,520

[45] Date of Patent: Jul. 23, 1991

[54] REFUSE DISPOSAL CONTAINER

[76] Inventor: Manfred Kuehmichel, Hasselbacher Weg 13, D-6295 Allendorf-Weilburg, Fed. Rep. of Germany

[21] Appl. No.: 405,028

[22] Filed: Sep. 6, 1989

[51] Int. Cl.[5] ..... B67C 3/30; B65D 6/18; B65D 8/02

[52] U.S. Cl. ..... 141/231; 141/333; 220/86.1; 220/259; 220/324; 220/85 CH; 220/252; 220/254

[58] Field of Search ..... 141/231, 88, 340–342, 141/333–334, 331, 391–392; 220/85 F, 86 R, 1 C, 5 R, 213, 259, 256, 324, 327, 85 SP, 85 CH, 338, 340, 263, 1 T, 244, 287, 252, 254, 317, 315, 337, 200, 213

[56] References Cited

U.S. PATENT DOCUMENTS

| | | | |
|---|---|---|---|
| 130,433 | 8/1872 | Knowles | 141/333 |
| 132,875 | 11/1872 | Stoessiger | 220/5 R |
| 520,505 | 5/1894 | Upton | 220/259 |
| 1,041,347 | 10/1912 | Potter | 220/5 R |
| 1,126,640 | 1/1915 | Jones | 220/259 |
| 1,137,355 | 4/1915 | Schell | 220/263 |
| 1,150,089 | 8/1915 | Wolfe et al. | 220/259 |
| 2,101,530 | 12/1937 | Brenzinger | 220/5 R |
| 3,062,398 | 11/1962 | Kordes | 220/259 |
| 3,229,846 | 1/1966 | Katz | 220/252 |
| 3,299,915 | 1/1967 | Clark | 141/231 |
| 4,127,216 | 11/1978 | Martin, Jr. et al. | 220/256 |
| 4,135,640 | 1/1979 | MacQuilkin et al. | 220/256 |
| 4,209,104 | 6/1980 | Speas | 220/5 R |
| 4,261,353 | 4/1981 | Bartels | 220/254 |
| 4,295,508 | 10/1981 | Metzger | 220/1 T |
| 4,300,597 | 11/1981 | Delay, Sr. | 220/337 |
| 4,319,762 | 3/1982 | Streit et al. | 220/1 C |
| 4,380,257 | 4/1983 | Howell | 141/392 |
| 4,494,672 | 1/1985 | Pearson | 220/259 |
| 4,509,567 | 4/1985 | Harrison et al. | 141/392 |
| 4,638,841 | 1/1987 | Heath | 141/98 |
| 4,698,861 | 10/1987 | Bogusz | 141/340 |
| 4,712,711 | 12/1987 | Geering et al. | 220/256 |

FOREIGN PATENT DOCUMENTS

| | | | |
|---|---|---|---|
| 88227 | 9/1983 | European Pat. Off. | 220/213 |
| 105840 | 11/1926 | Fed. Rep. of Germany | 220/85 SP |
| 629043 | 9/1949 | United Kingdom | 220/252 |

*Primary Examiner*—Henry J. Recla
*Assistant Examiner*—Keith Kupferschmid
*Attorney, Agent, or Firm*—Barnes, Kisselle, Raisch, Choate, Whittemore & Hulbert

[57] ABSTRACT

A refuse disposal container for receiving waste comprises a conventional drum, a top assembly for fixing to the upper end of the drum and a rolling support structure for supporting the drum. The top assembly can include a fixing ring or clamping band for embracing the upper edge portion of the drum and a pivotable cover to protect the drum contents from rain and the like. The rolling support structure may be in the form of a cart. The top assembly provides a hollow space for taking up a funnel and further tool. A filling device and a vent device each are provided with a metallic filter screen to protect the container against explosion.

12 Claims, 7 Drawing Sheets

REFUSE DISPOSAL CONTAINER

BACKGROUND OF THE INVENTION

The present invention concerns a refuse disposal container for receiving waste, and a method of disposing of waste. The invention also relates to an attachment cover assembly to be attached to a conventional drum of standard size, a transport cart for handling such a drum, a filling device and an explosion protection device to be used with such a drum.

One of the problems involved in waste disposal is the wide range of different materials that have to be disposed of, with different materials requiring to be treated and processed in different ways to dispose of them. That means that there is a need for waste materials to be safisfactorily sorted into their different categories in order to provide for effective disposal thereof.

For example, for the disposal of old or waste oil, containers which are referred to as waste oil collecting containers have been developed, which can be respectively connected to a suction device for sucking away the waste oil which is dumped in such containers. The waste oils involved include oils which are suitable for reprocessing, for example engine oils, transmission oils, turbine oils, machine oils and hydraulic oils, or there are waste oils which can only be used for energy purposes, for example metal machining oils, mineral-based insulating oils and the like, or yet again severely contaminated waste oils which can only be disposed of by special disposal procedures, for example emulsions, oil-water mixtures, solvents, waste oils contaminated with for example chlorine or PCB, oil filters and other oil-bearing materials and items of equipment. It will be appreciated that the suitability of waste oils for processing thereof also depends on the oils being supplied to the processing installation in properly sorted form. There is therefore a need for waste oils to be sorted and put into the correct container for receiving same, at the point of accrual. Similar requirements also arise in relation to cans, jars, packages and the like consisting of metal, plastic material, glass and so forth, as well as in the chemical field.

When sorting wastes, there is not always space available in rooms for putting up the containers, therefore the need arises to prepare the containers to be set up outdoors.

Sorted waste must be transported. Workshops and filling stations do not dispose of extended transporting facilities, therefore a simple and economic means is needed to transport containers (empty or filled with waste) so that the waste disposal system lends itself for broad use.

Wastes use to occur from time to time, therefore when collected in containers, such containers are mostly half empty. In the case of inflammable fluids damps may develop which bear the danger of explosion. Therefore it is necessary to protect the containers against explosion.

SUMMARY OF THE INVENTION

An object of the present invention is to provide a refuse disposal container for economical disposal of waste such as waste oils and chemicals for industrial procedures.

Another object of the present invention is to provide a refuse disposal container which affords enhanced versatility of use and can be used outdoors.

Still another object of the present invention is to provide a waste disposal system involving the use of a number of easily handleable containers of simple construction.

A further object of the present invention is to create a transporting facility for the disposal containers to give those containers a greater ease of handling.

Still a further object of the present invention is to enhance safety aspects when handling with inflammable fluids.

In accordance with the present invention, those and other objects are achieved by a refuse disposal container for receiving waste, comprising a drum for receiving the waste material. A top or cover assembly is adapted to be fitted to the drum, the top or cover assembly comprising a fixing or clamping ring which releasably embraces the upper end portion of the drum, a cover for selectively covering the top of the drum and the contents thereof, and hinge members for pivotably connecting the cover to the fixing ring. The arrangement further includes a transport means for handling the drum.

The refuse disposal container according to the invention for receiving waste thus comprises a top assembly which can be fitted to and removed from a drum of known configuration, as required, by virtue of the fixing ring being releasably fitted around the upper end portion of the respective drum. When the fixing ring is fitted to the drum, the cover can close off the top opening of the drum, thereby to protect the interior of the drum and any contents thereof. The cover can be suitably fixed in the closed position.

For disposal of waste consisting of a plurality of different kinds of waste, use is made of a corresponding number of refuse disposal containers according to the invention, which are each made up of a constant component, namely the top assembly and the transport means, and a variable component, namely the drum. The drum is referred to as a variable component in that, when a given drum of a refuse disposal container is full, that drum can be removed and replaced by a fresh empty drum, whereas the top assembly and transport means is reused with each new drum. The top assembly can be suitably marked to indicate the intended contents of the drum to which that top assembly is fixed, in order to reduce the risk of confusion when waste is being put into the respective drum. Thus, when the drum is full, the top assembly is removed therefrom and the filled drum is then taken to the point of disposal, re-use or processing. The top assembly is then fitted to a fresh drum.

It will be appreciated that that system and procedure is extremely economical, because it is possible to use drums of conventional configuration such as steel drums or lidded drums, as are employed for transporting oils and the like to filling stations. Also double walled drums can be used, especially for chemicals.

Further objects, features and advantages of the invention will be apparent from the following description of preferred embodiments thereof.

DESCRIPTION OF PREFERRED EMBODIMENTS

Figure 1:
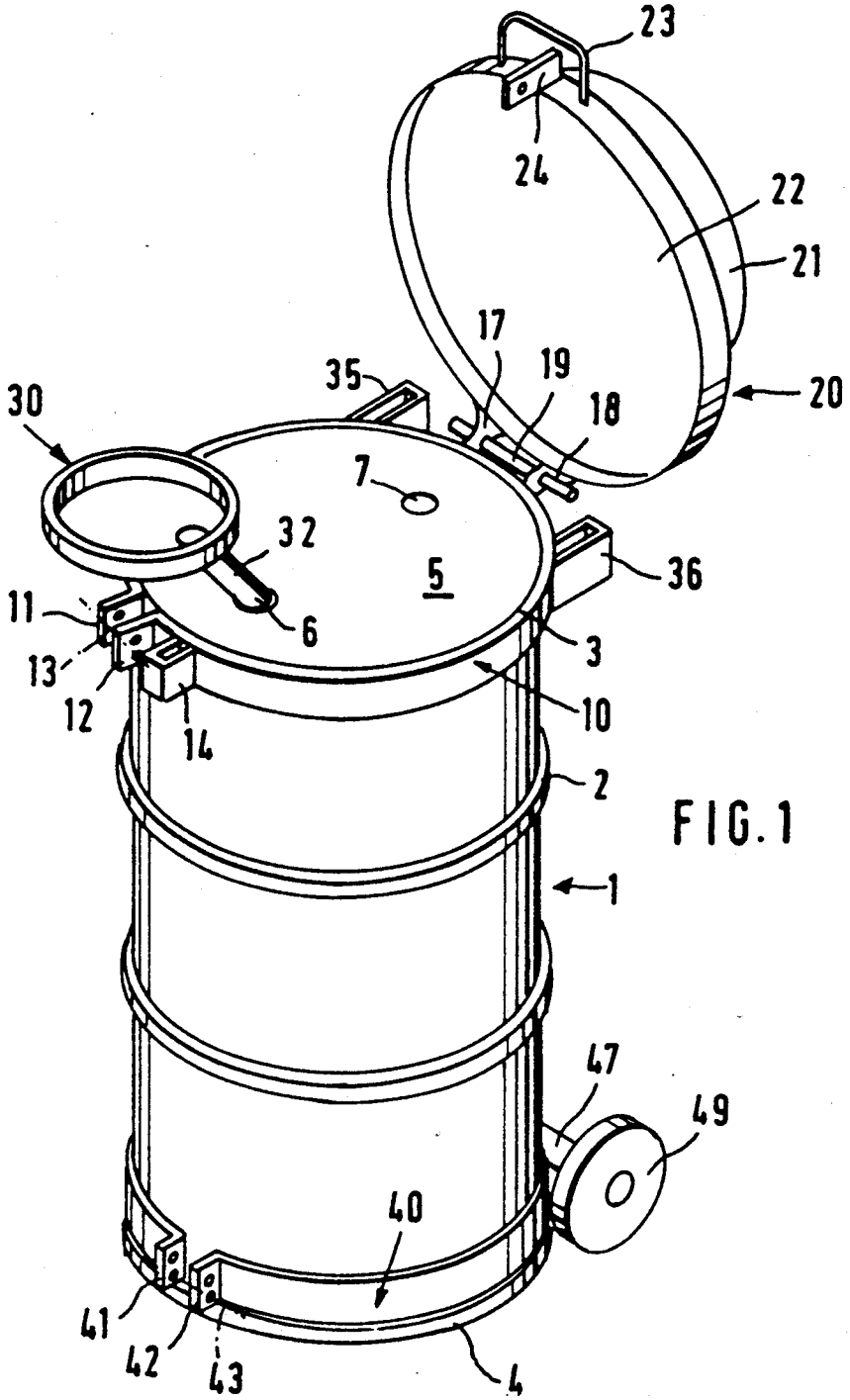
FIG. 1 is a perspective view of a first embodiment of a refuse disposal container.

Referring firstly to FIG. 1, shown therein is a standard drum 1 of 55 U.S. gallons which has hoop-shaped bead portions 2 extending around the barrel shell, reference numeral 3 indicating an upper end portion or rim of the drum 1 and reference numeral 4 indicating a lower end portion or rim thereof. Provided in an upper end wall 5 of the drum 1 are a filling opening 6 and a vent opening 7 both of standard sizes which can be closed by suitable screw caps or plugs. It is also possible for the drum to be in the form of what is known as a lidded drum, in which the end wall 5 is generally in the form of a lid. That drum configuration can be used in particular when the drum is to be employed for collecting waste material in lump or piece form.

Mounted to the upper end portion or rim 3 of the drum 1 is a top assembly comprising a first fixing ring 10 providing an open annular clamp-like configuration with respective bar portions 11 and 12 at each of the ends thereof so that the fixing ring 10 can be opened up in order for it to be fitted onto removed from the drum 1, and can then be tightened in clamping relationship around the drum 1 by means of screws 13 which urge the bar portions 11 and 12 towards each other to tighten the clamp configuration.

At a point on its periphery the fixing ring 10 carries first and second hinge brackets 15 and 16 which co-operate with further hinge brackets 17 and 18 which are fixed to a pivotable cover 20, with the hinge brackets 15, 16, 17 and 18 being pivotally connected together by a spindle 19 which passes therethrough. The spindle 19 may be replaced by respective screws which pass through each of the co-operating pairs of hinge members 15, 17 and 16, 18.

The hinge members 15 through 19 support the above-mentioned pivotable cover 20 on the fixing ring 3. The cover 20 comprises an annular rim 21 and a curved or domed cover wall portion 22. The cover 20 is also provided with a handle 23 and a closure bar portion 24 having an opening extending therethrough. When the cover 20 is pivoted into the closed position, the bar portion 24 engages into an eye-shaped closure bar member 14 on the fixing ring 10 and can be secured therein for example by means of a padlock, the shackle or bow member of which passes through the opening in the bar portion 24.

The above-defined construction leaves between the cover 20 and the end wall 5 of the drum 1 a hollow space in which a filling funnel component 30 can be disposed. The filling funnel component 30 comprises a filling bowl portion 31 and a pipe connection 32 which is possibly of a conically tapering configuration, together possibly with a screening or filter insert 33. The bottom of the filling bowl portion 31 is of an ellipsoidally curved configuration and in the vicinity of the one focus of the notional ellipse the pipe connection 32 extends away from the filling bowl portion 31 normal to the local tangent, that is to say, there is an angle of about 20° between the axis of the bowl portion 31 and the axis of the pipe connection 32, as can be best seen from FIG. 4.

By virtue of the filling funnel component 30 being of the above-described configuration, it is possible for the pipe connection 32 to be left in the filling opening 6 of the drum, irrespective of whether the bowl portion 31 is pivoted out over the edge of the drum, as shown in FIG. 1, for the purposes of more conveniently filling the drum, or whether the bowl portion is pivoted back into a position in which it lies in the space above the wall 5 of the drum 1 so that the cover 20 can be closed.

Figure 5:
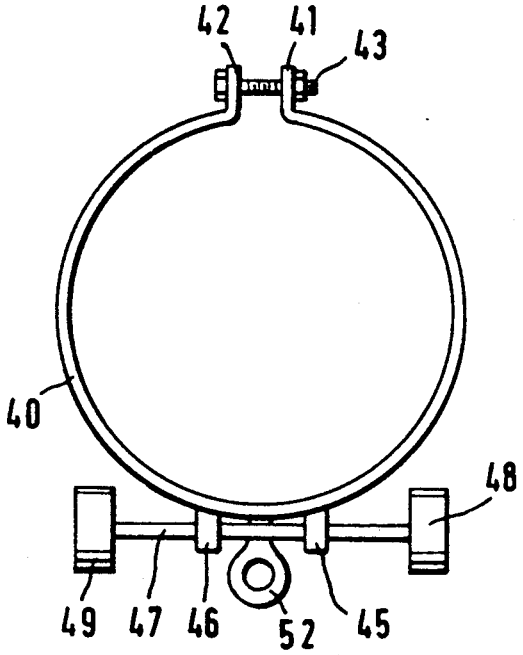
FIG. 5 shows a bottom fixing ring.

Releasably mounted to the lower end portion or rim 4 of the drum 1 is a second fixing ring 40 which is also of an annular clamp-like configuration and which is provided at its ends with bar portions 41 and 42 so that the ring can be expanded for fitting it to or removing it from the drum and then tightened around the drum for fixing it to the drum, by means of screws 43. Mounted to the fixing ring 40 are mounting portions or brackets 45 and 46 which can be more clearly seen in FIG. 5 and through which passes an axle 47. Wheels or rollers 48 and 49 are mounted at each of the ends of the axle 47. The axle 47 is held in the mounting portions 46 and 45 in such a way as to prevent it from being displaced axially therein, by means of suitable fixing devices as indicated at 50 such as split pins, circlips, or the like. At least one of the wheels or rollers 48 and 49 can be removed from the axle 47 in order to permit the axle 47 to be withdrawn from the mounting portions 45 and 46.

Figure 2:
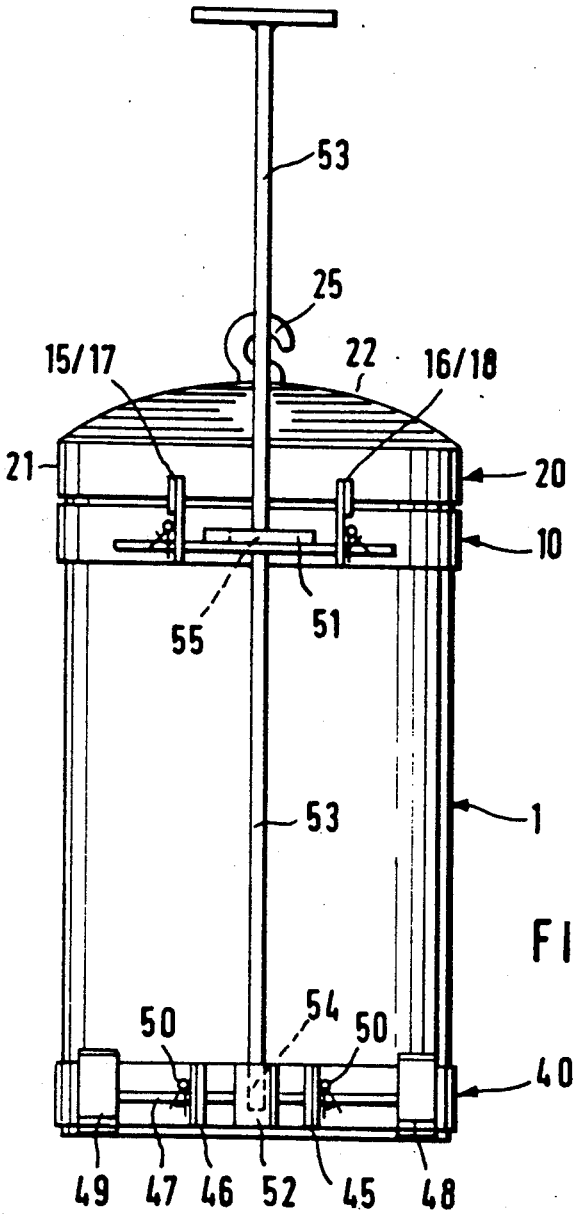
FIG. 2 is a view of the FIG. 1 container from the rear.
Figure 3:
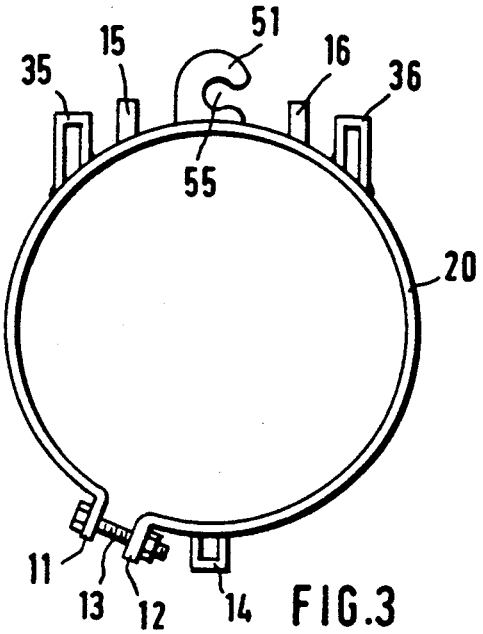
FIG. 3 is a detail of the container shown in FIGS. 1 and 2, namely a view from above of a fixing ring thereof.

Referring now to FIGS. 2 and 3, provided on the first or upper fixing ring 10 is a laterally open hook 51 while provided on the second or lower fixing ring 40 is a cup-like support 52, for receiving a gripping or handlebar 53 which is fitted with its lower end 54 into the opening in the support 52 and which can be engaged with a central shank portion 55 thereof into the opening in the hook 51, in order to form a container handle assembly which can be easily fitted to and removed from the container arrangement.

The members 45 through 50 form a rolling support for the drum 1 so that the container assembly can be moved in a slightly tilted condition using the bar 53 as a handle.

In order that the container can be lifted and dumped in the same way as a refuse container, two eye-like lugs 35 and 36 can be welded to the fixing ring 10.

It is also possible to use a crane winch to lift the entire container at a transportation eye 25, which is shown in FIG. 2, being welded to the apex of the domed configuration of the cover 20.

Reference will now be made to FIGS. 6 through 10 showing a further embodiment of the refuse disposal container and individual parts thereof. The same reference numerals are used to denote components of the first embodiment, which perform the same function in the second embodiment. Therefore only the differences between the two embodiments need to be discussed hereinafter.

Figure 6:
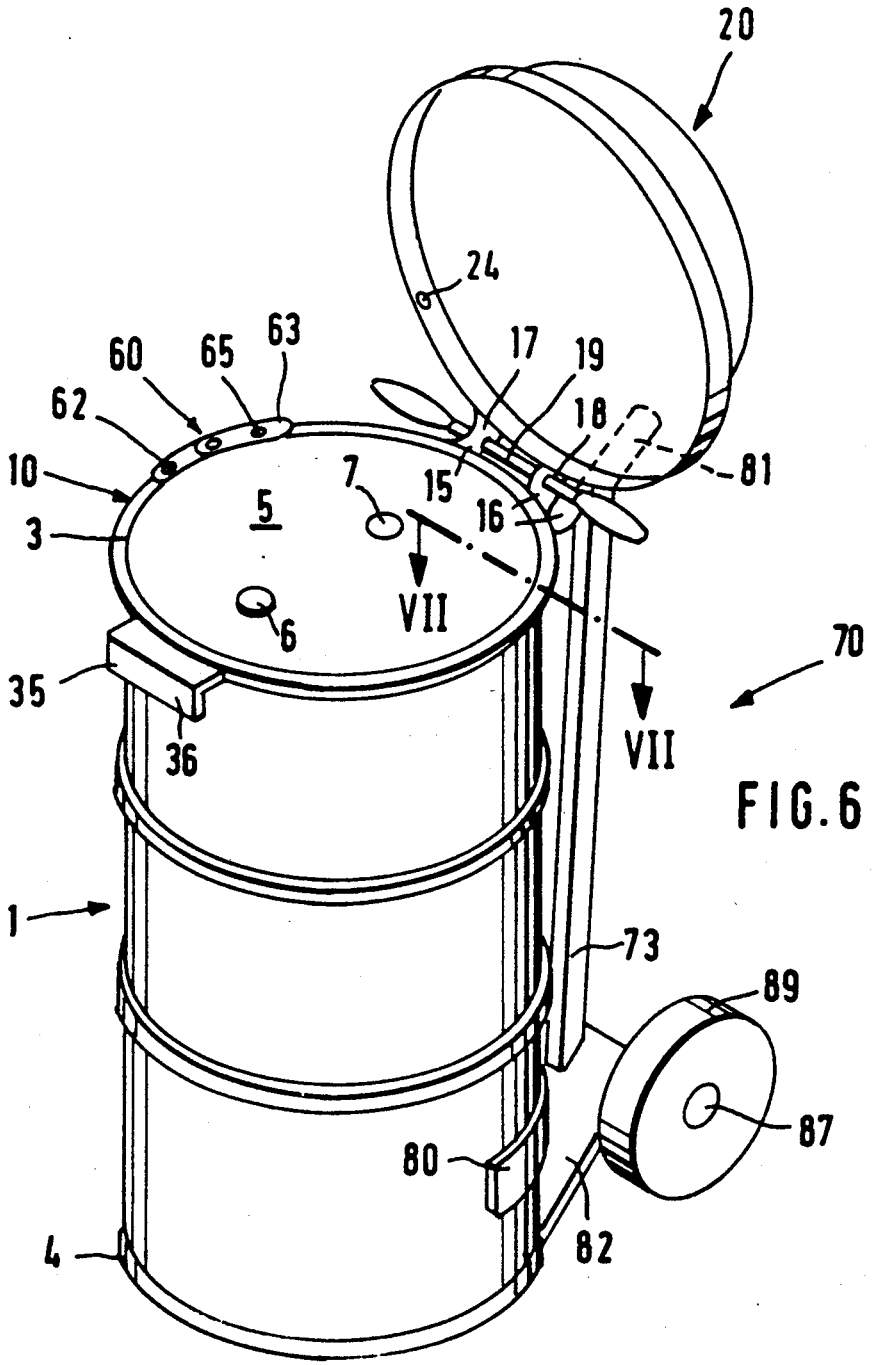
FIG. 6 is a perspective view of a second embodiment of a refuse disposal container.
Figure 7:
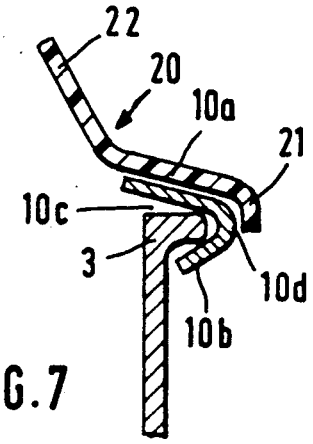
FIG. 7 is a sectional view on an enlarged scale of a detail from FIG. 6.
Figure 8:
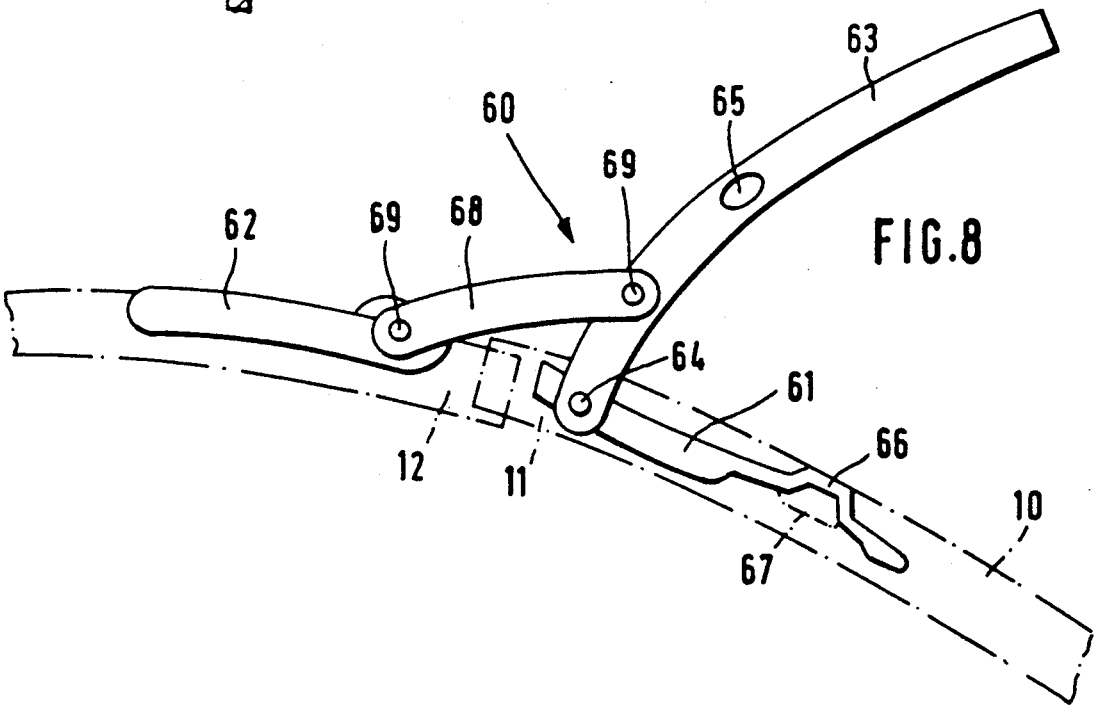
FIG. 8 is a view on an enlarged scale of a clamping lock device.

The first or upper fixing or clamping ring 10 is in the form of an open elastic clamp band, the slot of which is bridged across by a lever lock device 60 which is indicated in FIG. 6 and illustrated in greater detail in FIG. 8. As shown in broken lines in FIG. 8, the ends 11 and 12 of the clamping band 10 overlap each other; the clamping band 10 is of a V-shaped cross-sectional configuration with an upper longer limb 10*a* and a lower, shorter limb 10*b* as shown in FIG. 7, with a peripherally extending groove 10*c*, and with a base 10*d* of the V-shape being flattened. The annular rim portion 21 of the pivotable cover 20 is formed so as to satisfactorily engage over the clamping band 10 when the cover 20 is closed, as illustrated in FIG. 7 by means of a broken-away edge section.

As shown in FIG. 8, the lever lock device 60 has a bar portion 61 for fixing to the end 11 of the clamping band 10 and a bar portion 62 for fixing to the end 12 of the clamping band 10. A handle lever 63 of V-shaped cross-sectional configuration corresponding to that of the clamping band 10 can be applied around the outside surface of the clamping band 10, as shown in FIG. 6, and opened away therefrom, as shown in FIG. 8. For that purpose a shaft or spindle 64 extends through the end 11 of the clamping band 10 and a corresponding bore in the bar portion 61 which is fitted snugly to the inside surface of the clamping band 10 and is secured in position therein for example by spot welding. The lever 63 has an opening 65 intermediate its ends, and the bar portion 61 has an outwardly extending bend portion 66, with the opening 65 and the portion 66 being disposed at the same spacing from the pivot axis formed by the shaft or spindle 64 and coinciding with an opening 67 in the clamping band 10 so as to form an opening for receiving the shackle or bow member of a padlock. The openings 65 and 67 coincide with the opening 24 in the cover 20 when the cover 20 is in a closed condition. The lever 63 and the bar position 62 are connected together by way of two mutually parallel connecting levers 68 and shafts or spindles 69. When the lever 63 is pivoted towards the closed position as shown in FIG. 6, a pulling force is applied to the end 12 of the clamping band 10 by way of the connecting lever 68 so that the two ends 11 and 12 of the clamping band are pushed further one into the other and the peripheral dimension of the clamping band 10 is reduced, whereby the inside diameter of the opening defined by the clamping band is similarly reduced.

The clamping band 10 is of such a dimension that its shorter limb portion 10*b* can be pushed over the upper and end portion or rim 3 (see FIG. 7) of the drum, when the lever lock device 60 is in its open condition while when the lever lock device 60 is closed, the circular opening defined by the clamping band 10 is reduced to such an extent that the shorter limb portion 10*b* of the clamping band 10 engages behind the edge upper end portion or rim 3 as shown in FIG. 7. The longer limb portion 10*a* is at any event of such a length that even when the lever lock device 60 is in the open condition, the longer limb portion 10*a* is supported on the upper end portion or rim 3 so that the clamping band 10, in the opened condition, can be easily and conveniently fitted on to the drum by being simply put on to the upper end portion or rim 3, with the lever 63 then being pivoted into the closed position to clamp the fixing band around the upper end portion of the drum.

The hinge members 15 through 19 in the embodiment shown in FIGS. 6 through 10 may be similar to those of the first embodiment. However the spindle 19 which passes therethrough is of a particularly long configuration, and gripping or handle members are pushed with a press fit on to the projecting ends of the spindle 19, the handle members also serving at the same time as a securing means to hold the spindle 19 in position.

The lugs 35 and 36 which are adapted to be engaged by a lifting and tipping means, as found for example on refuse collection vehicles, are formed as an angle bar member in the illustrated embodiment, which is welded to the fixing band 10 diametrally opposite to the hinge members 15 through 19.

Figure 9:
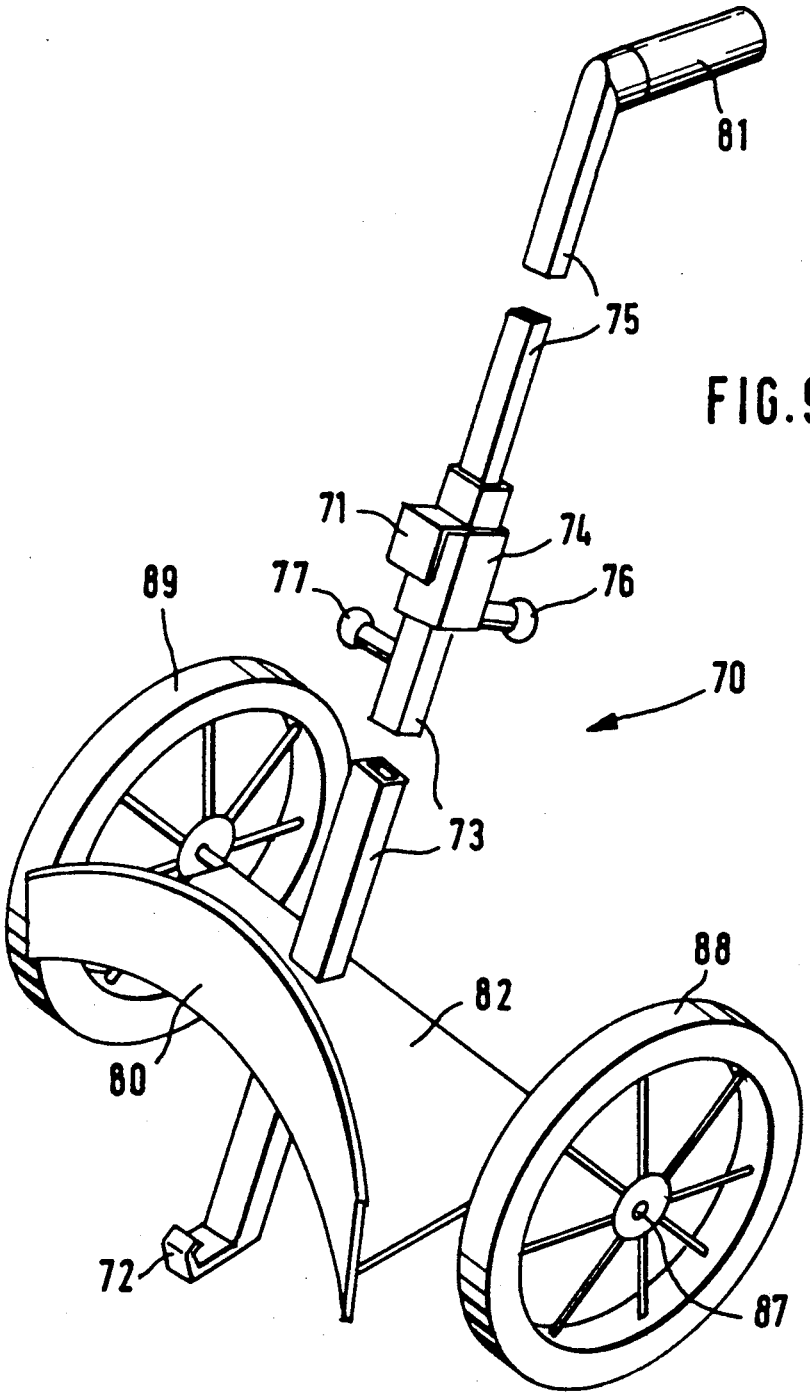
FIG. 9 is a diagrammatic perspective view of a carrier cart.

FIG. 9 shows an embodiment 70 of the transport means, which is in the form of a support carriage or cart. For releasably fixing the drum 1 to the cart, it has hooks 71 and 72 which engage behind the handlebar 19 and the lower end portion or rim 4 respectively of the drum and which for that purpose can be displaced relative to each other. The handlebar of the FIG. 9 structure comprises three portions 73, 74 and 75, wherein the portions 74 and 75 are telescopically displaceable on and in the portion 73 and can be locked in predetermined latching positions. For that purpose the arrangement has latching pins 76 and 77 which respectively co-operate with rows of holes in the bar portions 73 and 75.

Figure 10:
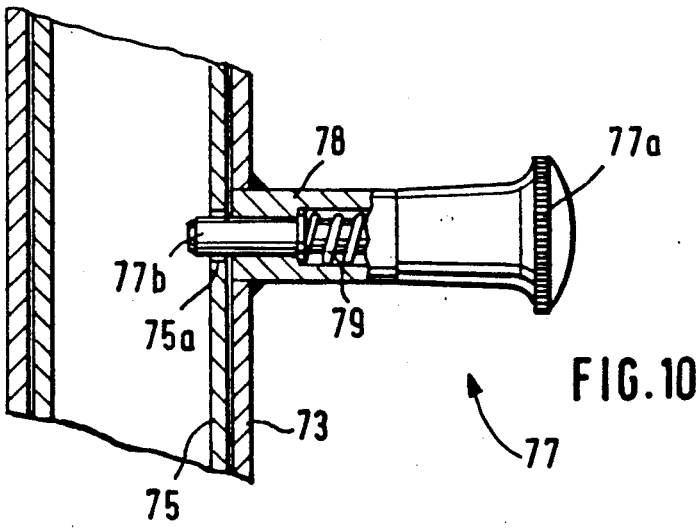
FIG. 10 is a view of a detail in the region of a handlebar from the FIG. 9 construction illustration a locking pin arrangement.

FIG. 10 is a partly sectional view through the latching pin 77 shown in FIG. 9. The outer end thereof is in the form of a gripping portion 77*a* while the inner end is in the form of a locking member 77*b*. The pin 77 is slidably guided in a sleeve 78 and is urged into the engagement position illustrated by a spring 79. As mentioned, the bar portion 75 has a row of holes, of which one hole 75*a* is shown in FIG. 10. After the pin 77 has been pulled out, the portion 75 can thus be displaced in the portion 73 and can be locked in a different position, after the locking member 77*b* has engaged into a corresponding hole 75*b*, in order to set the grip or handle 81 of the FIG. 9 structure at a suitable height. If the bar portion 75 is displaced entirely into the bar portion 73, in the condition shown in FIG. 6, the grip or handle 81 serves as a support member for the cover 20 when in the opened condition.

The latching pin 76 corresponds in terms of its structure to the above-described latching pin 77, but the sleeve 78 thereof is welded to the bar portion 74 which is of a collar-like configuration, and the spring 79 cannot urge the latching pin entirely into the corresponding hole in the row of holes in the bar portion 73, because the bar portion 75 is still disposed within the bar portion 73. However partial engagement of the front end portion 77*b* of the latching pin is sufficient for locking the collar-like bar portion 74. The drum 1 is loaded with the lower end portion or rim 4 thereof on to the hook 72 and the bar portion 74 is lowered until the hook 71 carried thereon engages behind the spindle 19, whereupon the locking pin 76 secures the assembly in that position.

The cart-like transport device 70, instead of a complete lower fixing ring, has only a supporting means adapted to support the barrel shell of the drum 1, when the cart 70 is pivoted into an inclined position. To that end, a ring portion 80 extends around a certain part of the periphery of the drum 1. The ring portion 80 is fixedly connected by way of a plate 82 to the bar portion 73, for example by welding. An axle 87 for wheels 88 and 89 is mounted on the plate 82. The means for laterally supporting the drums can also be made up of tube stock, welded together to a frame that is fixed to the bar 73 and houses the axle 87 for the wheels 88, 89.

The embodiment illustrated in FIGS. 6 through 10 has the advantage that the drums 1 to be carried thereby can be quickly and conveniently changed. In that connection the cover 20 should not be too heavy, so that it is preferably made from a material such as plastic material, for example glass fibre-reinforced plastic material or injection-molded polyethylene or polystyrene.

Commercially available drums occur in several standard sizes and having a single wall (such drums f. i. are used for oil) or a double wall (such drums for instance are used for chemicals). It is to be understood that the top or attachement cover assembly and the rolling support means or the transport cart can be designed and adjusted for the respective size of drum to be used. Depending on the nature and the variety of the specific waste which is to be disposed of, a suitable number and kind of refuse disposal containers is set up, and the containers are suitably identified. As the annular rim portion 21 of the cover as shown for example in FIG. 1 engages over the edge of the drum, rain and splash or spray water are substantially prevented from reaching the upper end wall of the drum and therefore cannot penetrate into the interior of the drum. The refuse disposal containers can therefore also be set up in the open air. In order to safeguard the containers from unauthorised use, the closure means for same may include an insertion-type lock or the like for locking the containers shut.

A plurality of containers as described above in accordance with the invention can be used for intermediate storage of dumped waste, of different kinds such as cans, jars, packages and the like of metal, plastic material glass and the like, with each kind of waste being accomodated in a respective, suitably identified container.

Figure 4:
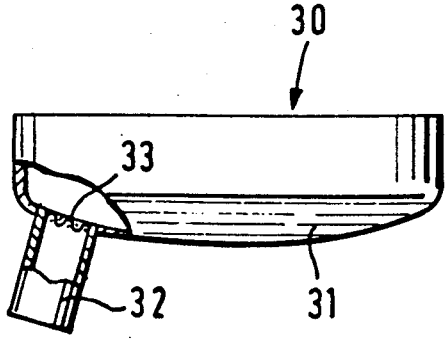
FIG. 4 shows a further detail of the construction of FIGS. 1 through 3, illustrating a filling funnel component.
Figure 11:
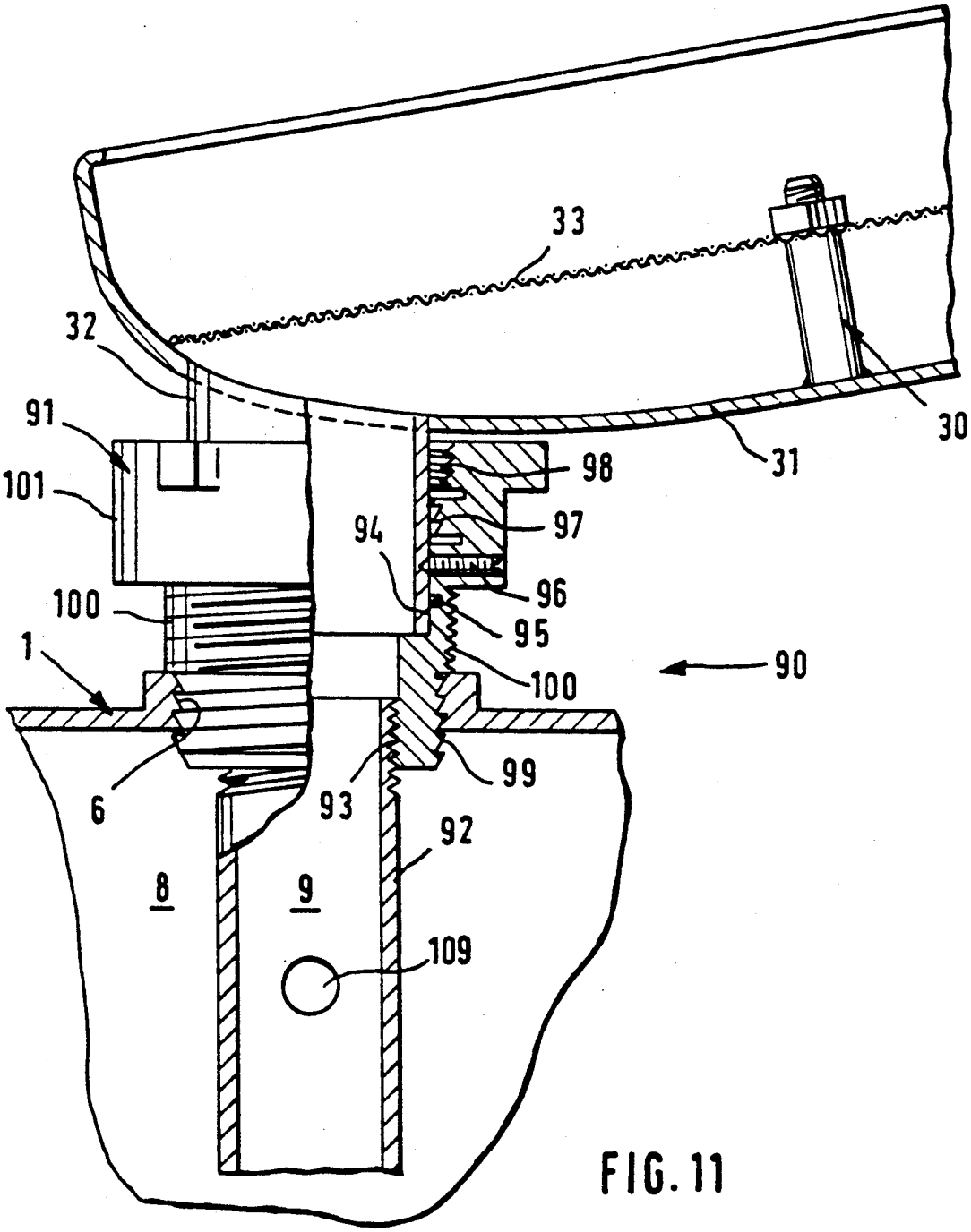
FIG. 11 is a sectional view, partially broken away, of the upper end of a filling device.

The filling device includes a funnel component 30 similar to that shown in FIG. 4 and a filling tube-like member 90, the upper end thereof being shown in FIG. 11. The funnel component 30 comprises an ellipsoidally curved filling bowl portion 31, a pipe connection 32 and a filter mesh or screen insert 33. The filling tube-like member 90 includes a screw head 91 and an immersion tube 92 which may be connected together fixedly or detachably. The screw head 91 has the shape of a ring with stepped surfaces having different and inner and outer diameters. The smallest annular inner surface 93 is fitted to the outer diameter of the immersion tube 92 and may be provided with a fine thread for fixing the immersion tube 92. The next annular inner surface 94 is fitted to the outer diameter of the pipe connection 32 so that the latter can be inserted. This stacking connection is sealed by an O-ring 95 which is inserted in a groove in the screw head 91 in the region of the inner surface 94. Furthermore, a transverse screw hole 96 for a wing-bold screw (not shown) may be provided to clamp the pipe connection 32 and fix same. On the inner side of the screw head 91, a buttress thread 97 and a fine thread 98 are provided, which correspond to the thread of the lids of drums for chemicals and for oil, respectively.

On the outer side, the screw head 91 comprises a buttress thread 99 corresponding to the buttress thread 97 and a fine thread 100 corresponding to the fine thread 98. Both types of thread can be combined, that is, the fine thread 100 may be cut into the flanges of the coarser buttress thread, so that the regions 99 and 100 partially overlap. Based on the buttress thread 99 and the fine thread 100, the screw head 91 may be screwed into the filling opening 6 of a drum 1 which may be of a type for chemicals or for oil, both types of drums having different screws at its respective filling openings.

Figure 12:
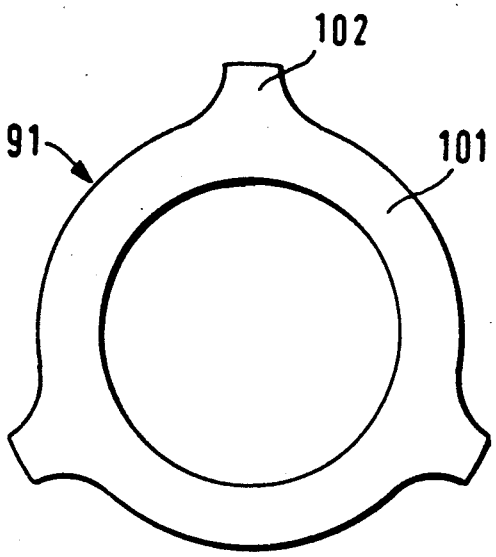
FIG. 12 is a view from above on a screw head.

At its upper end, the screw head 91 is shaped as a ring 101 having gripping extensions 102 as best can be seen from FIG. 12.

The immersion tube 92 can be provided as a simple piece of tube having the appropriate length according to the height of the respective drum 1. The immersion tube 92 should end immediately above the lower bottom wall of the drum 1 so that the lower end of the immersion tube 92 will soon be below the surface of the fluid to be filled in. By this arrangement, the fluid filled in will produce less damp when further fluid is filled in from time to time as it will be the rule for the intended use of the drum.

Figure 13:
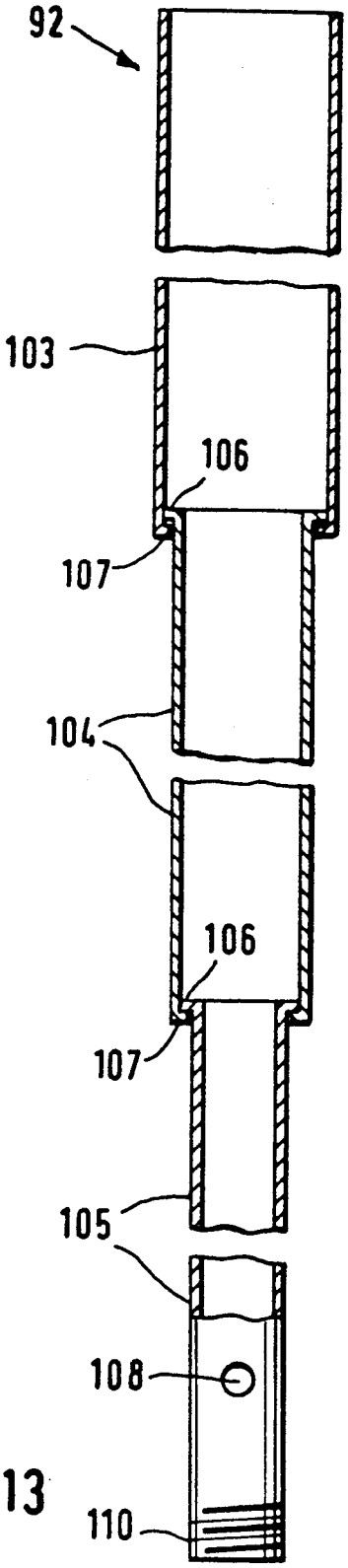
FIG. 13 is a sectional view of the lower end of the filling device in a possible embodiment.

As FIG. 13 shows, the immersion tube 92 may be composed from single tube sections 103, 104, 105, which are shaped with successively smaller diameters and have inwardly and outwardly extending flanges 106 and 107, respectively, at its ends so as to telescope and to form a stop. Near the lower end of the immersion tube 92 a transverse bore 109 may be provided which is an outlet for the filled in fluid in any case, when the lower end 109 should touch the bottom of the drum. The embodiment of the immersion tube 92 shown in FIG. 13 can be used for different sizes of drums.

When the filling device 90 together with the funnel 30 is screwed into the filling opening 6 of a drum 1, such device is a certain protection against explosion, since the metallic filter screen 33 is a flame obstacle between the interior and the exterior of the drum. Also the fact that the immersion tube 92 normally is dipped into the fluid, leads to the separation of the bigger space 8 within the drum from the smaller space 9 within the device 90.

The explosion protection is completed by a venting device which has a certain similarity to the screw head 91 by comprising, at its outer side, buttress thread 99 and fine thread 100 adapted to the filling opening 6 of drums for chemicals as well as for oil, and a prolongation tube member having ¾ inch thread fitted for the vent opening 7 of a number of drum types. The interior of the vent device offers space to take up an activated carbon filter in order to absorb the vapours which may be carried by the venting air. Above and below of the activated carbon filter, each screen wire filter is provided to form a flame obstacle, the upper end of the device carries a mushroom-like venting lid which enables passage of filtered air and protects against entering water spray.

It is to be understood that the filling device can be closed by detaching the funnel component 30 and screwing the usual lid of the drum on the thread 97 or 98 depending on the type of drum. When the drum is filled, the filling device is detached and the usual lid of the drum screwed into the opening 6.

It will be appreciated that the above-described constructions have been set forth solely by way of example of the principles of the present invention and that various modifications and alterations may be made therein without thereby departing from the spirit and scope of the invention.

What is claimed is:

1. A refuse disposal container for receiving waste comprising:

a drum having an upper flat end wall, a lower flat end wall and a generally cylindrical shell, all being of a standard size;

said upper end wall comprising filling and venting opening means for said drum;

said generally cylindrical shell comprising an upper rim portion and a lower rim portion, said upper rim portion extending above said upper end wall and said lower rim portion extending below said lower end wall of said drum;

a top assembly mounted to said upper rim portion of said drum and including a fixing ring means for readily attaching and detaching said assembly to said upper rim portion of said drum, a domed cover dimensioned so as to fit over said fixing ring means, and hinge means for pivotably connecting said cover to said fixing ring means; and transport means removably secured to and supporting said lower rim portion and said generally cylindrical shell of said drum for handling of said refuse disposal container.

2. The container as set forth in claim 1 wherein said transport means comprise a mounting means adapted to support said lower rim portion and said generally cylindrical shell of said drum and a rolling support mounted on said mounting means.

3. The container as set forth in claim 2 wherein said mounting means include a bar comprising a first, a second and a third telescopic bar portions, means for locking said second and third bar portions in different positions relative to said first bar portion, hook means on said first bar portion for engaging said lower rim portion of said drum and hooks means on said second bar portion for engaging said top assembly of said drum, and a handle on said third bar portion.

4. The container set forth in claim 1 wherein the cover comprises an annular rim portion for cooperating with said fixing ring means, said domed cover defining a closed hollow space is left free between said upper flat end wall of said drum and said cover when said cover is supported on said fixing ring means, and further including closure means for closably connecting said cover to said fixing ring means.

5. The container as set forth in claim 4 including a filling funnel means adapted to said filling and venting opening means of said drum, and sized to be accommodated in said space between said upper end wall and said cover, said filling funnel means comprising a filling bowl portion and a pipe connection eccentrically carried thereon.

6. The container as set forth in claim 1 wherein said fixing ring comprises two ends and a lock lever means connected to said ends, said lock lever means including a handle lever which can take up a first open position and a second closed position, said handle lever in said first position spreading said fixing ring to an opening width sufficient to be put onto said upper rim portion of said drum, and in said second position narrowing said fixing ring to an opening width sufficient to clamp said ring on said upper rim portion of said drum.

7. The container set forth in claim 6 wherein said cover has an annular rim portion covering said handle lever when both are closed, said annular rim portion and said fixing ring each have a small opening, which are arranged so that said small openings being mutually aligned when said handle lever is in its closed position and said cover closed.

8. A method of disposing of waste of different kinds including intermediate storage of the waste with each kind of waste being received in a suitably identified separate refuse disposal container, each said container comprising a drum having an upper flat end wall, a lower flat end wall and a generally cylindrical shell, all being of a standard size;

said upper end wall comprising filling and venting opening means for said drum;

said generally cylindrical shell comprising an upper rim portion and a lower rim portion, said upper rim portion extending above said upper end wall and said lower rim portion extending below said lower end wall of said drum;

a top assembly adapted to be mounted to said upper rim portion of said drum and including a fixing ring means for releasably embracing said upper rim portion of said drum, a domed cover dimensioned so as to fit over said fixing ring means, and hinge means for pivotably connecting said cover to said fixing ring means; and transport means adapted to support said lower rim portion and said generally cylindrical shell of said drum for handling of said refuse disposal container.

9. A refuse disposal container for receiving waste comprising a drum for receiving the waste which in use is disposed in a substantially upright position and which has a first upper end portion and a second lower end portion, said first upper end portion including an upper flat wall and an upper rim portion and said second lower end portion including a lower flat wall and a lower rim portion of said drum, and a drum support means including:

a first mounting means cooperating with said upper rim portion of said drum for readily attaching and detaching said upper end portion of said drum to said drum support means;

a cover pivotably attached to said first mounting means and adapted to pivot between a closed position wherein said upper end of said drum is closed and a position of exposing said upper end of said drum;

a second mounting means for releasably securing said lower end portion of said drum to said drum support structure; and wheel means on said second mounting means for rollingly supporting said drum.

10. A refuse disposal container for receiving waste comprising:

a drum having an upper end, a lower end and a barrel shell of standard cross section;

an upper end wall on the upper end of the drum having a filling opening and a venting opening, a top assembly mounted to said upper end of said drum and including a fixing ring means for readily attaching and detaching said assembly to said upper end of said drum, a cover dimensioned so as to fit over said fixing ring means, and hinge means for pivotably connecting the cover to said fixing ring means; and transport means removably secured to and supporting said lower end and said barrel shell of said drum for handling of said refuse disposal container, the cover comprising an annular rim portion for cooperating with said fixing ring means and a curved cover wall whereby a closed hollow space is left free between said upper end of said drum and said cover when said cover is supported on said fixing ring means, and further including closure means for closably connecting said cover to said fixing ring means, a filling funnel means for filling said drum, accommodated in said space and comprising a filling bowl portion and a pipe connection eccentrically carried thereon.

11. A refusal disposal container for receiving waste comprising:

a drum having an upper end, a lower end and a barrel shell of standard cross section;

a top assembly mounted to said upper end of said drum and including a fixing ring means for readily attaching and detaching said assembly to said upper end of said drum, a cover dimensioned so as to fit over said fixing ring means, and hinge means for pivotably connecting the cover to said fixing ring means; and transport means removably secured to and supporting said lower end and said barrel shell of said drum for handling of said refuse disposal container, said fixing ring means including projections adapted to be engaged when said drum is to be tipped.

12. A refuse disposal container for receiving waste comprising:

a drum having an upper generally flat end wall, a lower generally flat end wall and a generally cylindrical shell, all being of a standard size;

said upper end wall comprising filling and venting opening means for said drum;

said generally cylindrical shell comprising an upper rim portion and a lower rim portion, said upper rim portion extending above said upper end wall and said lower rim portion extending below said lower end wall of said drum;

a top assembly mounted to said upper rim portion of said drum and including a fixing ring means for readily attaching and detaching said assembly to said upper rim portion of said drum, a domed cover dimensioned so as to fit over said fixing ring means, and hinge means for pivotably connecting said cover to said fixing ring means; and transport means removably secured to and supporting said lower rim portion and said generally cylindrical shell of said drum for handling of said refuse disposal container, said top assembly including projecting means adapted to be engaged when said drum is to be tipped.

* * * * *